US011364980B2

(12) United States Patent
Cohen

(10) Patent No.: US 11,364,980 B2
(45) Date of Patent: Jun. 21, 2022

(54) LIFT VEST WITH WEBBING TO REDUCE OR ELIMINATE VERTICAL SLIDING

(71) Applicant: James S. Cohen, New York, NY (US)

(72) Inventor: James S. Cohen, New York, NY (US)

( * ) Notice: Subject to any disclaimer, the term of this patent is extended or adjusted under 35 U.S.C. 154(b) by 109 days.

(21) Appl. No.: 16/674,883

(22) Filed: Nov. 5, 2019

(65) Prior Publication Data

US 2021/0129956 A1 May 6, 2021

(51) Int. Cl.
*A61G 7/10* (2006.01)
*B63C 9/11* (2006.01)

(52) U.S. Cl.
CPC . *B63C 9/11* (2013.01); *A61G 7/10* (2013.01)

(58) Field of Classification Search
CPC ..... B63C 9/11; A61G 7/10; A61G 7/1023; A61G 7/1038; A41D 13/0007
See application file for complete search history.

(56) References Cited

U.S. PATENT DOCUMENTS 2,166,809 A * 7/1939 Frankel ..... A62B 35/005 182/6
3,701,395 A * 10/1972 Theobald ..... A62B 35/0018 182/3
6,122,778 A 9/2000 Cohen
10,420,689 B1 9/2019 Foster et al.
2004/0128734 A1* 7/2004 Jordan ..... A62B 35/0018 2/69
2004/0163156 A1 8/2004 Schweer
2010/0299830 A1* 12/2010 Thomas ..... A61G 7/1023 5/81.1 T

FOREIGN PATENT DOCUMENTS

WO 2005034677 A1 4/2005
WO 2014087388 A2 6/2014

* cited by examiner

*Primary Examiner* — Fredrick C Conley
(74) *Attorney, Agent, or Firm* — GableGotwals

(57) ABSTRACT

A lift vest of this disclosure includes a base garment shaped to cover at least a substantial portion of an upper torso of a patient, a waist belt connected to the base garment, and a pair of crotch belts removably connected to the waist belt. The base garment may include a chest a waist belt interconnected by cross-webbing. Pulling on one or both of the belts in any direction causes the webbing to tighten about the wearer's torso. The lift vest may include a pair of knee belts connected to the waist belt. The knee belts can be fixed to the waist belt or removably connected to it. The knee belt may include a removable connection along its length. Other embodiments include a base garment covering the upper torso below the armpits and having a single belt connected to garment that provides a hand hold.

11 Claims, 4 Drawing Sheets

LIFT VEST WITH WEBBING TO REDUCE OR ELIMINATE VERTICAL SLIDING

BACKGROUND

This disclosure is in the field of lift vests that enable a caregiver to assist a patient wearing the vest to move from one position to another. The vests typically include a base garment shaped to cover at least a substantial portion of the torso (chest, abdomen, and back) of the patient and belts connected to the base garment that provide hand holds for the caregiver. U.S. Pat. No. 6,122,778 to Cohen, the contents of which are incorporated by reference herein, provides an example.

The prior art lift vests work best in non-emergency situations, where there is sufficient time to equip the patient with the vest, and when worn by patients that can bear weight. Even when worn by weight-bearing patients, the vest may slide upwards during use, causing the top or chest belt to move upwards towards the patient's arms.

SUMMARY

Embodiments of a lift vest of this disclosure include a base garment shaped to cover at least a substantial portion of an upper torso of a patient, a waist belt connected to the base garment, and a pair of crotch belts removably connected to the waist belt. Removable connections may include quick-release buckles of a kind known in the art, hook-and-loop fastener of a kind known in the art, or some combination of the two. The connections may be adjustable connections.

In other embodiments, the base garment includes a chest and a waist belt interconnected by cross-webbing. Pulling on one or both of the belts in any direction causes the webbing to tighten about the wearer's torso.

In some embodiments, the lift vest includes a pair of vertical belts connected to the waist belt, each vertical belt including a belt at one end for attachment around a thigh of a user above the knee. The vertical belts can be fixed to the waist belt or removably connected to it. The vertical belt may include a removable connection along its length.

Other embodiments of a lift vest of this disclosure include a base garment covering the upper torso below the armpits and having a single belt connected to garment that provides a hand hold.

DETAILED DESCRIPTION

Figure 2:
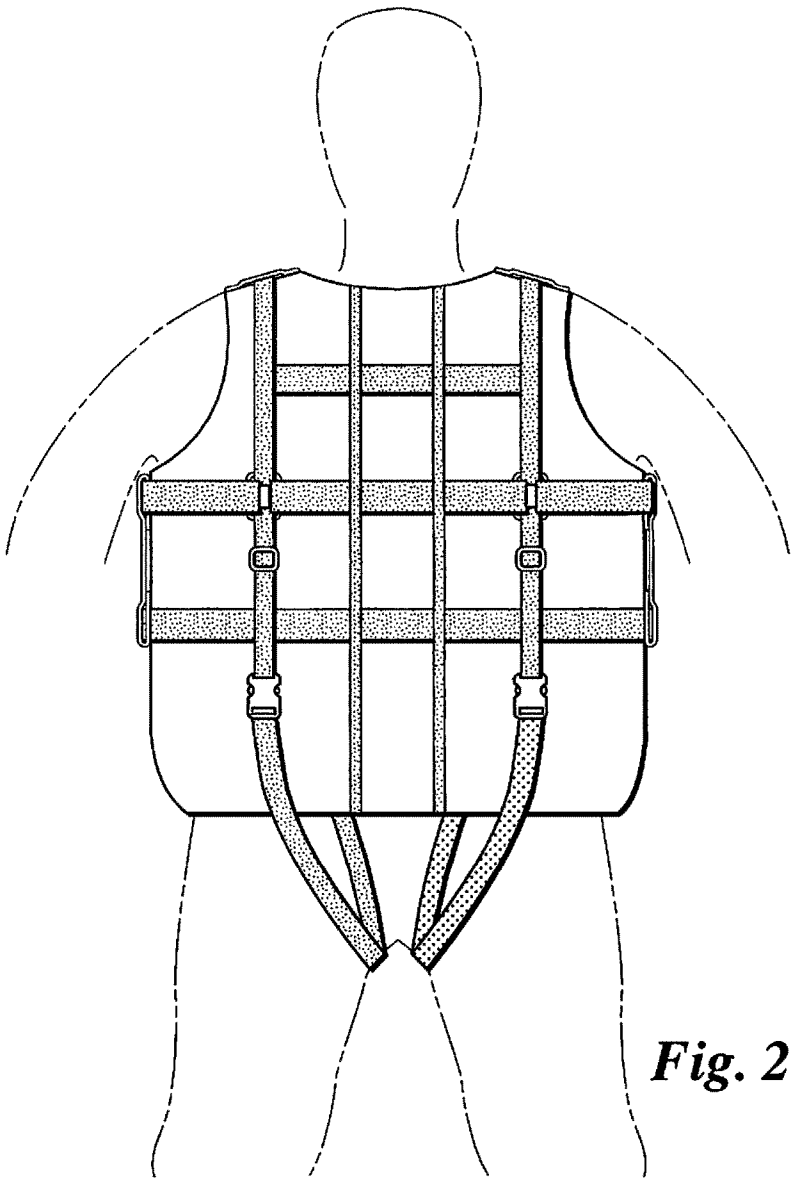
FIG. 2 is a rear elevation view of the vest of FIG. 1.
Figure 1:
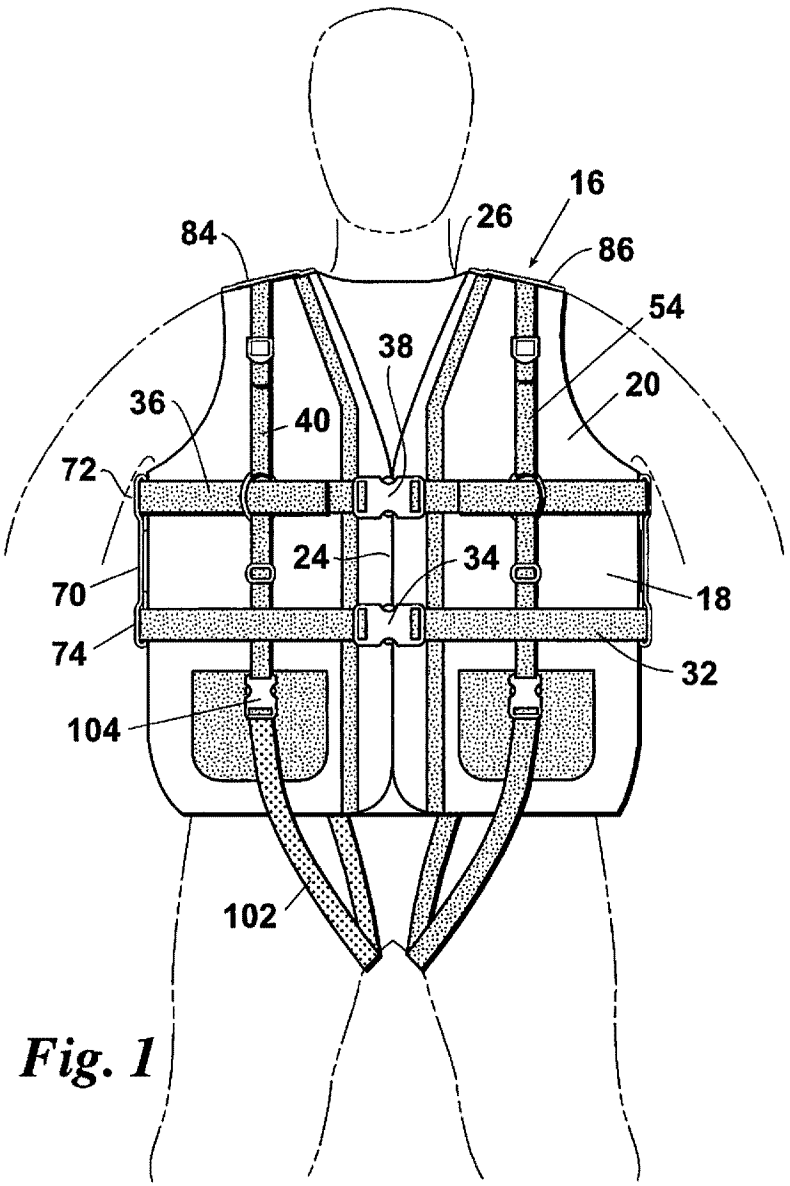
FIG. 1 is a front elevation view of an embodiment of a lift vest of this disclosure.

In embodiments of a lift vest of this disclosure, the vest includes a garment with a lifting structure that helps transfer a caregiver's lifting force to the wearer's torso so the wearer may be lifted or moved. For purposes of this disclosure, torso refers to an area generally containing the chest, abdomen, and back. Upper torso means the chest and upper back (opposite that of the chest).

Lower torso means the abdomen and the lower back (opposite that of the abdomen). A lift vest means a device worn by a patient as a clothing item and configured for safe patient handling and mobility during transfer and repositioning of the patient in any direction: front, back, or side. The vest may be made of fabric suitable for clothing items. The vest is foldable and rollable (unlike vests that contain flotation)

Referring to the drawings, embodiments of a lift vest 16 of this disclosure include a basic fabric garment 18 that is similar in many respects to a sleeveless vest but includes a lifting structure surrounding and forming a part of the vest that provides numerous hand hold places that enable a caregiver to assist the vest wearer. The garment 18 may include sleeve holes 20, a front 24 that may be closeable open front, a neck opening 26, and may be sized to cover the wearer's torso. The neck opening 26 may be a V-shape or rounded neck opening. In other embodiments, the garment 18 is a poncho-style garment (no closeable open front). In some embodiments, the garment 18 does not include sleeve holes 20 and is intended to only cover the upper torso below the armpits. The garment 18 may include a fire-resistant fabric of a kind known in the art.

The lifting structure may include one or more belts 32, 36, 40, 54 made of webbing and received by respective loops 72, 74, 84, 86 connected to the garment 18. A double belt loop 70 may form loops 72, 74. In some embodiments, the garment 18 includes only a chest belt 36. Waist belt 32 may include a single or double adjustable buckle 34 so that the length of waist belt 32 can be adjusted to snugly but comfortably fit around the waist of the wearer. Similarly, chest belt 36 may include a single double adjustable buckle 38 so that the length of the chest belt 36 can be adjusted to snugly but comfortably fit around the upper torso portion of the patient. Waist belt 32 and chest belt 36 may be arranged horizontal and parallel to each other. In embodiments, the vest 16 may include shoulder straps 40, 54 the same or similar to those as disclosed in U.S. Pat. No. 6,122,778 to Cohen, the contents of which are incorporated by reference herein. The straps 40, 54 may include a shoulder lift strap secured to the straps 40, 54. Loops 84, 86 may serve as the lift strap.

Figure 4:
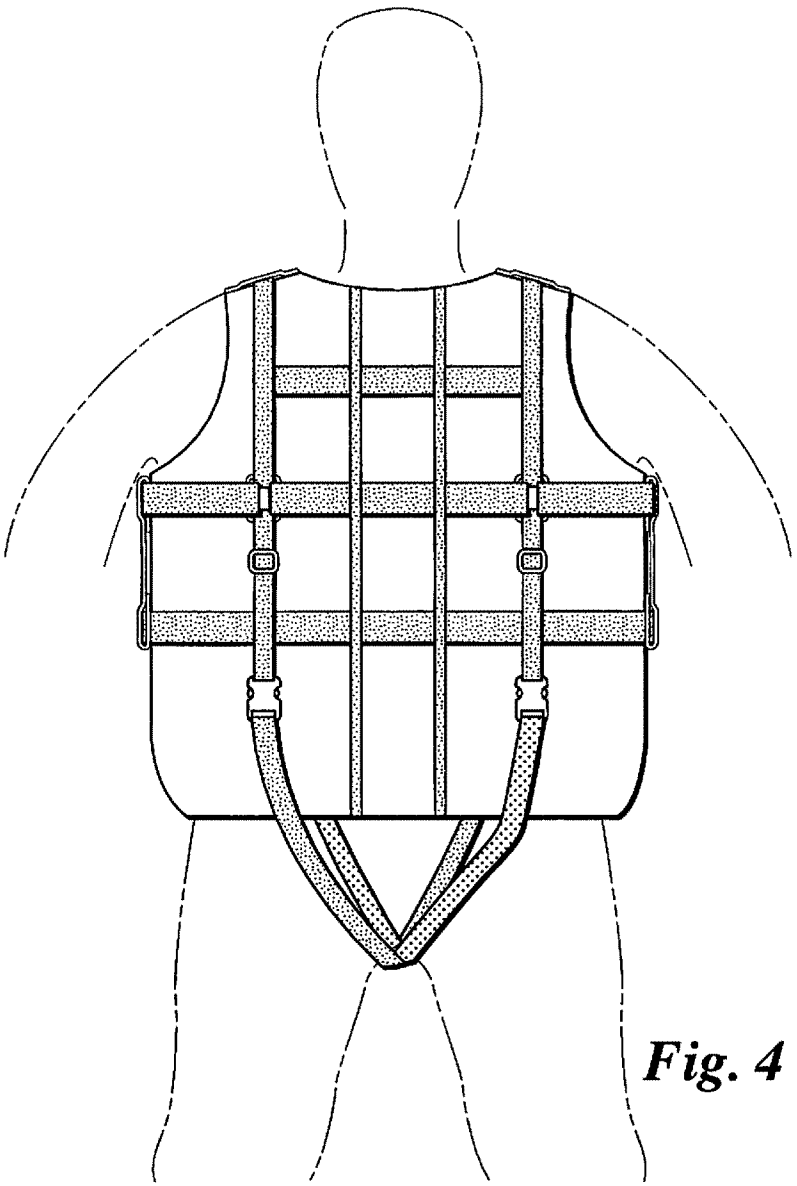
FIG. 4 is a rear elevation view of the vest of FIG. 3.
Figure 3:
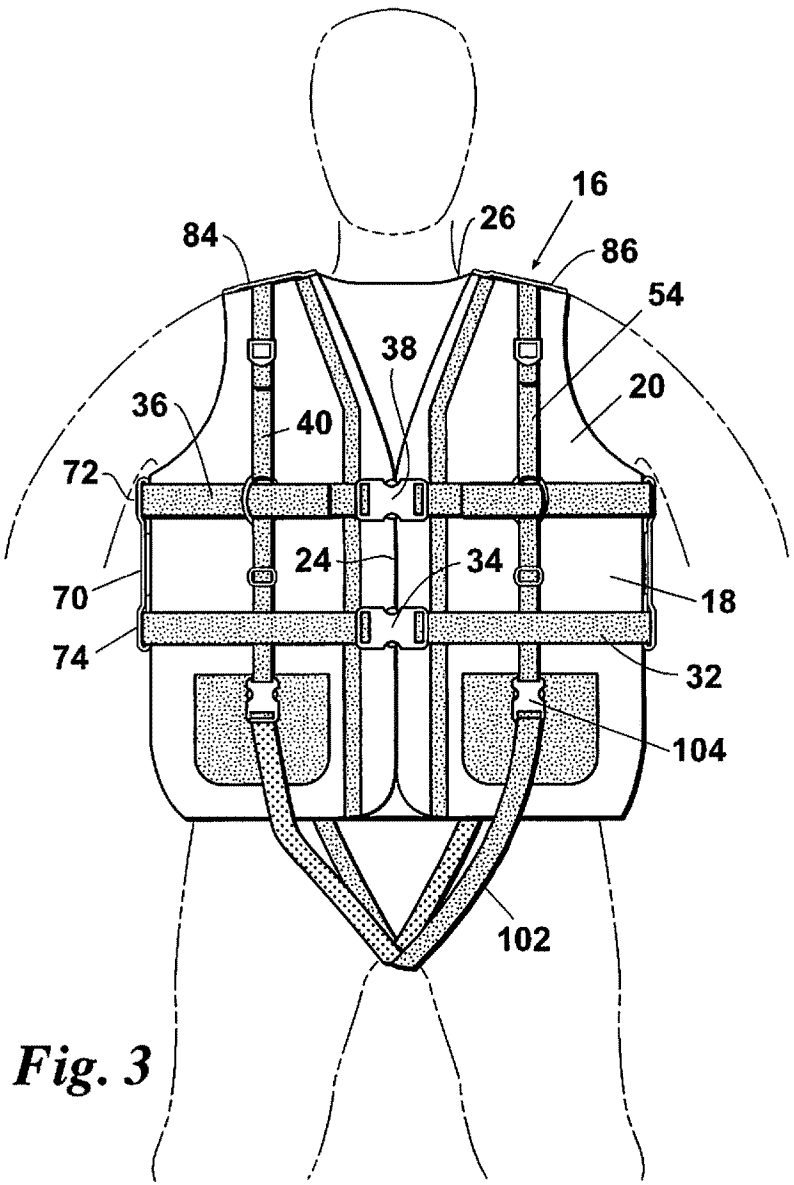
FIG. 3 is a front elevation view of another embodiment of a lift vest of this disclosure.

Embodiments of the lift vest 16 may include a pair of crotch belts 102 removably connected to the waist belt 32 by connectors 104. Connectors 104 may include quick-release buckles of a kind known in the art, hook-and-loop fastener of a kind known in the art, or some combination of the two. The connections may be adjustable connections. The crotch belts 102 help prevent the vest 16 from sliding upwards during vertical lifting movements. This is especially helpful when the wearer cannot bear her or his own weight. The crotch belts 102 may be crossed. See FIGS. 3 & 4. In some embodiments, the waist and chest belts 32, 36 may be configured like that shown in FIGS. 7 & 8 or 9 & 10.

Figure 5:
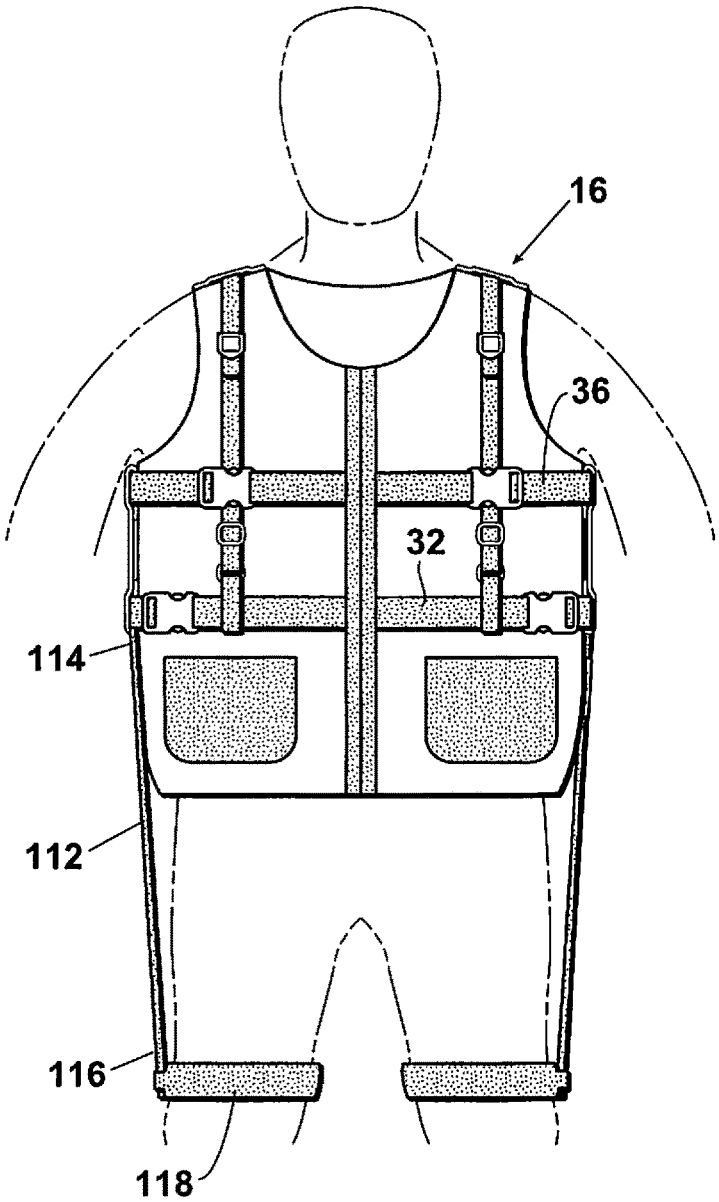
FIG. 5 is a front elevation view of yet another embodiment of a lift vest of this disclosure.
Figure 6:
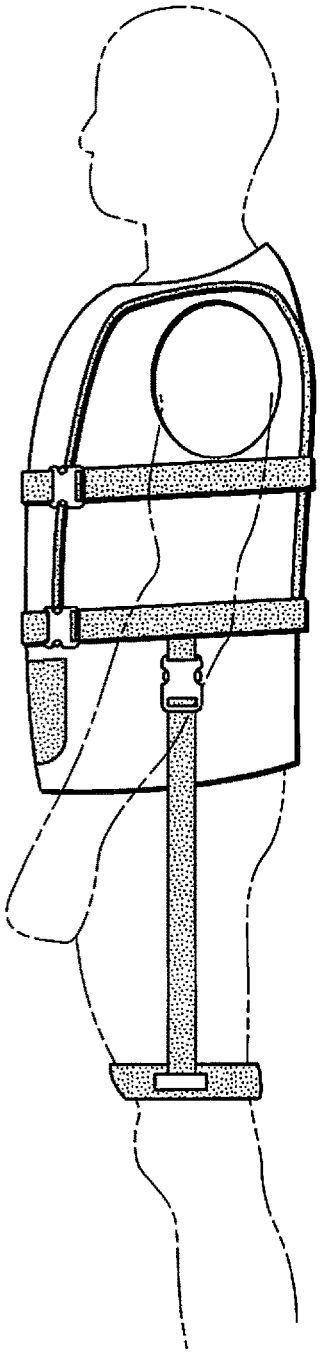
FIG. 6 is a side elevation view of the vest of FIG. 5.

Referring now to FIGS. 5-6, embodiments of the lift vest 16 include a vertical belt 112 made of webbing that is fixedly or removably connected at one end 114 to the waist belt 32 and at another end 116 to a belt 118 (also made of webbing) for connection about a thigh of a user. The removable connections may be made using connectors the same as or similar to connectors 104. In embodiments, belt 118 is an adjustable belt and may include a hook-and-loop fastener.

Similar to the crotch belts 102, these thigh belts 118 help prevent the vest 16 from sliding upwards during vertical lifting movements. In some embodiments, the waist and chest belts 32, 36 may be configured like that shown in FIGS. 7 & 8 or 9 & 10.

Figure 7:
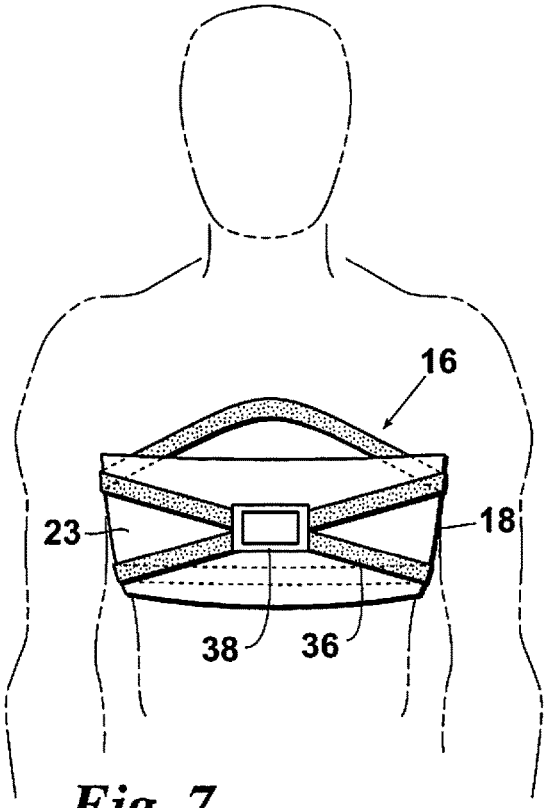
FIG. 7 is a front elevation view of still yet another embodiment of a lift vest of this disclosure.
Figure 8:
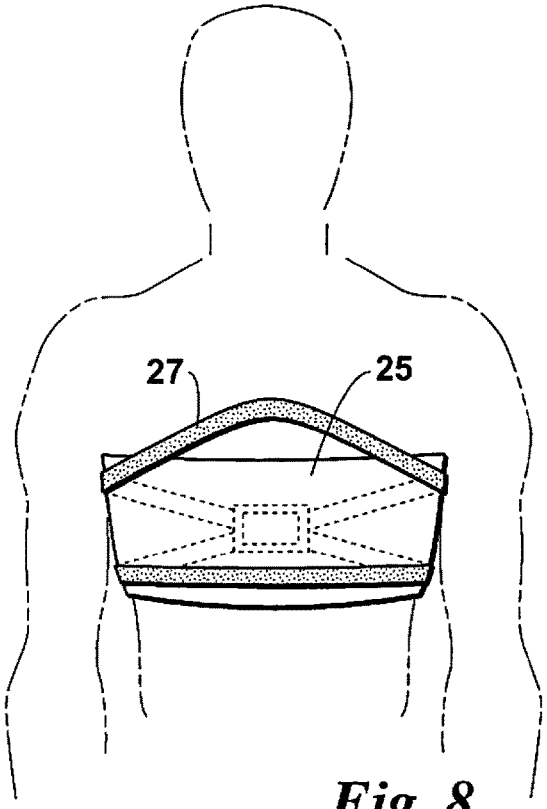
FIG. 8 is a rear elevation view of the vest of FIG. 7.

Referring now to FIGS. 7 & 8, embodiments of the lift vest 16 include a chest belt 36 made of webbing that overlaps on itself—crossing on front 23 of the garment 18—ending with a half-loop 27 located along the back 25 of the garment 18 that serves as a handle. The garment 18 is sized to cover the upper torso below the armpits and opens and closes with a single buckle 38. The vest 16, which may be used in emergency situations like those encountered in police, fire, and rescue operations, self-tightens when the handle is pulled, preventing the vest 16 from slipping off no matter how much force is applied during a drag or lift.

Figure 9:
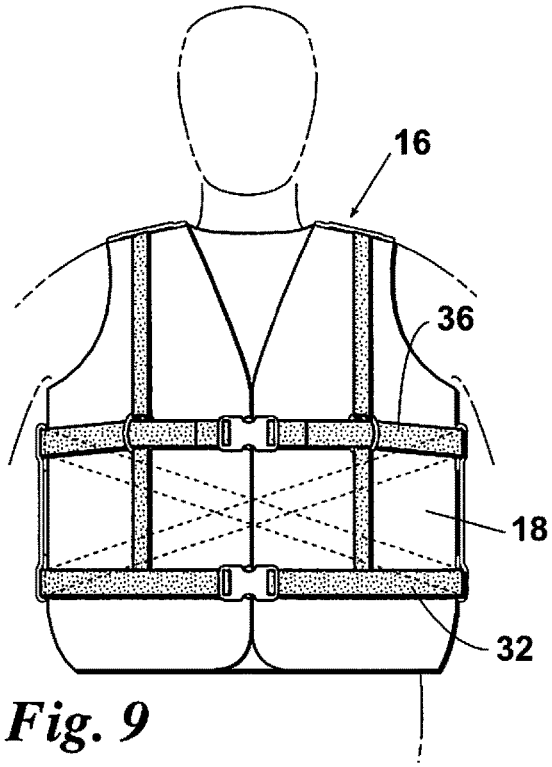
FIG. 9 is a front elevation view of another embodiment of a lift vest of this disclosure.
Figure 10:
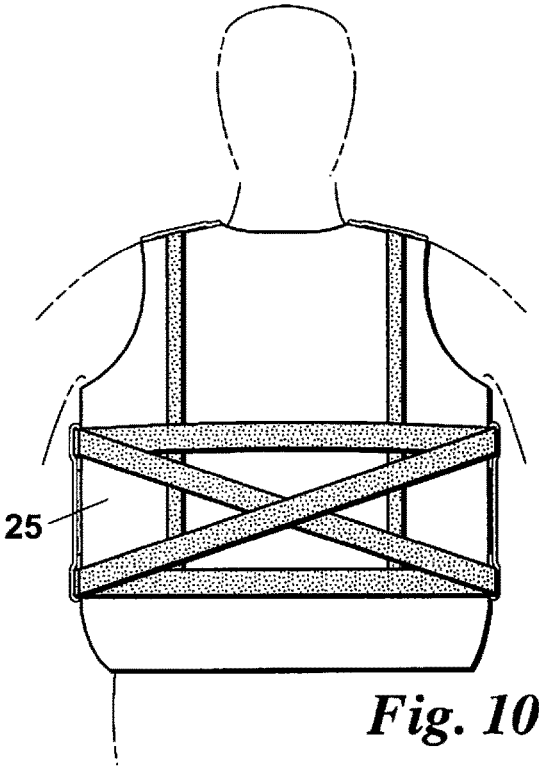
FIG. 10 is a rear elevation view of the vest of FIG. 9.

Referring now to FIGS. 9 & 10, embodiments of the lift vest 16 include interconnected chest and waist belts 32, 36, with the belts 32, 36 made of webbing and crossing one another along a back 25 of the garment. When a belt 32, 36 is pulled in any direction, the webbing tightens the garment 18 around the torso of the wearer, preventing the vest 16 from sliding in a vertical direction. In some embodiments, the vest 16 may also include crotch belts 102 or thigh belts 118. See FIGS. 5 & 6.

While embodiments of the lifting vest have been described and illustrated, modifications apart from those shown or suggested here may be made without departing from the scope of the following claims. The terms that are employed in the claims draw their meaning from the use of the terms in the specification. The same terms employed in the prior art may be broader in meaning than specifically employed here. Whenever there is a question between the broader definition of such terms used in the prior art and the more specific use of the terms herein, the more specific meaning is meant.

The invention claimed is:

1. A lift vest including:

a base garment including a front panel and a back panel connected to one another along a shoulder portion of the base garment and along each side of the base garment;

hand holds connected to an exterior surface of the base garment by which a caregiver may assist a wearer of the lift vest in moving from one position to another or in standing or walking; and a lifting structure, connected to the exterior surface of the front and back panels comprising a chest belt;

a waist belt; and a pair of vertical belts, each vertical belt of the pair connected at one end to the waist belt; and a pair of thigh belts, each thigh belt of the pair connected to another end of the vertical belt;

wherein a portion of the front panel extends between the chest and waist belts; and wherein another portion of the front panel extends between the pair of vertical belts.

2. The lift vest of claim 1, further comprising:

the chest and waist belt interconnected and crossing over one another along the back panel of the base garment.

3. The lift vest of claim 1, further comprising:

the one end of each vertical belt connected to the waist belt including a removeable connector.

4. The lift vest of claim 1, further comprising:

the another end of each vertical belt connected to the thigh belt including a removeable connector.

5. The lift vest of claim 1, further comprising:

each thigh belt being an adjustable thigh belt.

6. A lift vest including:

a base garment including a front panel and a back panel connected to one another along a shoulder portion of the base garment and along each side of the base garment;

hand holds connected to the base garment by which a caregiver may assist a wearer of the lift vest in moving from one position to another or in standing or walking; and a lifting structure, connected to an exterior surface of the front and back panels comprising:

a chest belt;

a waist belt;

the chest and waist belt interconnected and crossing over one another along the back panel of the base garment;

a pair of thigh belts, each thigh belt of the pair including an end connected to the waist belt;

wherein a portion of the front panel extends between the chest and waist belts; and wherein another portion of the front panel extends between the waist belt and the pair of thigh belts.

7. The lift vest of claim 6, further comprising:

a pair of vertical belts, each vertical belt of the pair connected at one end to the waist belt; and each thigh belt of the pair connected to another end of the vertical belt;

wherein another portion of the front panel extends between the pair of vertical belts.

8. The lift vest of claim 7, further comprising:

the one end of each vertical belt connected to the waist belt including a removeable connector.

9. The lift vest of claim 7, further comprising:

the another end of each vertical belt connected to the thigh belt including a removeable connector.

10. The lift vest of claim 7, further comprising:

each thigh belt being an adjustable thigh belt.

11. The lift vest of claim 6, wherein, the lift vest is foldable and rollable.

* * * * *